US009067655B1

(12) United States Patent
Fusco

(10) Patent No.: US 9,067,655 B1
(45) Date of Patent: Jun. 30, 2015

(54) SURF WAX GROOMING TOOL WITH RADIALLY EXTENDING COMBS

(71) Applicant: John Joseph Fusco, San Marcos, CA (US)

(72) Inventor: John Joseph Fusco, San Marcos, CA (US)

( * ) Notice: Subject to any disclaimer, the term of this patent is extended or adjusted under 35 U.S.C. 154(b) by 0 days.

(21) Appl. No.: 14/195,037

(22) Filed: Mar. 3, 2014

(51) Int. Cl.

| | |
|---|---|
| ***A47L 13/02*** | (2006.01) |
| ***B63B 35/79*** | (2006.01) |
| ***A47L 13/08*** | (2006.01) |
| *B05C 11/04* | (2006.01) |

(52) U.S. Cl.
CPC ..... *B63B 35/7933* (2013.01); *A47L 13/08* (2013.01); *B05C 11/041* (2013.01)

(58) Field of Classification Search
CPC ..... B05C 11/042; B05C 11/041; A47L 13/08
USPC ..... 15/236.05, 236.06, 236.08, 236.1, 15/235.6, 245.1; 119/625, 630, 631, 632, 119/633; 132/148, 219, 286
See application file for complete search history.

(56) References Cited

U.S. PATENT DOCUMENTS

| | | | | | |
|---|---|---|---|---|---|
| 560,468 | A | * | 5/1896 | Burke | 119/631 |
| 627,806 | A | * | 6/1899 | Earl | 15/236.06 |
| 630,686 | A | * | 8/1899 | Grant et al. | 119/631 |
| 913,862 | A | * | 3/1909 | Weber | 30/170 |
| 955,444 | A | * | 4/1910 | Stern | 30/170 |
| 1,120,832 | A | * | 12/1914 | McElhenie | 15/105 |
| 1,387,027 | A | * | 8/1921 | Watrous | 144/115 |
| 1,652,915 | A | * | 12/1927 | Staehle | 144/115 |
| 2,863,163 | A | * | 12/1958 | Flam | 15/142 |
| 2,977,620 | A | * | 4/1961 | Nilsson | 15/142 |
| 3,601,874 | A | * | 8/1971 | Sakamoto et al. | 29/76.1 |
| 4,295,274 | A | * | 10/1981 | Bricher et al. | 30/347 |
| 5,454,130 | A | * | 10/1995 | Lammon | 15/93.1 |
| 5,839,151 | A | * | 11/1998 | Whaley | 15/236.05 |
| 5,950,312 | A | * | 9/1999 | Poole et al. | 30/172 |
| 6,247,686 | B1 | * | 6/2001 | Gabbin | 267/147 |
| 6,821,041 | B1 | | 11/2004 | Hallam et al. | |
| 7,694,381 | B2 | | 4/2010 | Heaslet | |
| 8,434,187 | B2 | * | 5/2013 | Weinberger et al. | 15/111 |
| 2005/0278866 | A1 | | 12/2005 | Madarieta | |
| 2006/0248792 | A1 | * | 11/2006 | Huxley | 47/1.5 |
| 2007/0277336 | A1 | | 12/2007 | Heaslet | |
| 2011/0294381 | A1 | | 12/2011 | Nazzari | |
| 2011/0308035 | A1 | * | 12/2011 | Casper | 15/344 |
| 2012/0170964 | A1 | | 7/2012 | Bogdanoff | |
| 2013/0008464 | A1 | * | 1/2013 | Varner | 134/6 |

FOREIGN PATENT DOCUMENTS

| | | |
|---|---|---|
| WO | WO2009058132 | 5/2009 |

* cited by examiner

*Primary Examiner* — Monica Carter
*Assistant Examiner* — Michael Jennings
(74) *Attorney, Agent, or Firm* — Stetina Brunda Garred & Brucker

(57) ABSTRACT

A wax grooming tool for a water sports board. The grooming tool includes a plurality of combs extending radially outward from a central portion of the tool toward a peripheral portion of the tool. The plurality of combs allows a user to save time when combining or grooming the wax on the water sports board by reducing the amount of repetitions required to complete the combining or grooming. The unique configuration of the grooming tool further results in creating a swirl pattern in the wax and saved wax by thoroughly grooming the existing wax to a freshly-waxed state.

12 Claims, 3 Drawing Sheets

SURF WAX GROOMING TOOL WITH RADIALLY EXTENDING COMBS

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present disclosure generally relates to a grooming tool for a water sports board, and more specifically to a wax comb having a plurality of comb elements extending radially outward from a central portion of the comb.

2. Related Art

The deck of a surfboard is the surface upon which a surfer typically stands while surfing. It is well known in the art to coat the deck with wax to enhance the traction on the surfboard. A common tool used for grooming the surf wax is a wax comb, which typically includes a small, relatively rigid plastic sheet with teeth formed along one edge. The wax comb may be used after the wax is initially applied to the board to roughen the wax for optimal traction. It is also common to use a wax comb to "revive" wax that has been worn smooth during use of the surfboard. Furthermore, if a surfboard sits unused for an extended period of time, the wax may lose its grip or tack. One of the easiest ways to revive the wax is to comb it using a wax comb.

Although a wax comb may be used to revive wax on a surfboard, it is sometimes necessary to remove all of the existing wax to provide more comprehensive resurfacing. To that end, a scraping tool may be used to remove the existing wax from the board. Oftentimes, the scraping tool is simply a rectangular metal or plastic plate having one or more relatively sharp edges formed thereon. The scraping tool may be an integral part of the wax comb, or alternatively, the scraping tool may be entirely separate from the wax comb.

A common problem encountered by surfers relates to the time required to sufficiently comb or groom one's surfboard. This is particularly problematic for longboard surfers due to the large surface area associated with the longboards. Since the combs are relatively small in size, several passes are needed to go over the entire waxed portion of the surfboard.

Another problem commonly associated with conventional surf wax combs is that the wax combs may be easily misplaced or dropped in the sand and the likelihood of losing the comb is quite high and frequently occurs.

Yet another problem typically associated with conventional surf wax combs is that wax tends to collect on the teeth of the comb after the comb has passed through the wax. The collected wax typically creates several undesirable consequences. For instance, as the wax builds up on the comb, the effectiveness of the comb may decrease. Along these lines, the wax may fill the gaps between the teeth, which may reduce the "bite" or sharpness of the teeth. Furthermore, the built-up wax may fall or drip from the comb in undesirable areas, thereby creating dirty or cluttered conditions.

Accordingly, there is a need in the art for a surf wax grooming tool which more efficiently grooms wax on a surfboard relative to conventional wax combs. Furthermore, there is a need in the art for a wax grooming tool that is easier to use, is less likely to become misplaced or lost, and also mitigates the occurrence of wax inadvertently falling therefrom. Various aspects of the present invention are directed toward addressing these needs, as will be discussed in more detail below.

BRIEF SUMMARY

As described herein, several aspects of the present invention are directed toward a wax grooming tool for a water sports board. The grooming tool includes a plurality of comb elements coupled to a base and extending radially outward from a central portion of the base toward a peripheral portion of the base. The incorporation of a plurality of combs elements within a single, manually controllable wax comb allows a user to save time when combing or grooming the wax on the water sports board by reducing the amount of repetitions required to complete the combing or grooming. Furthermore, the unique configuration of the grooming tool additionally results in saved wax by thoroughly grooming the existing wax to a freshly-waxed state.

According to one embodiment, there is provided a grooming tool for a water sports board. The grooming tool includes a base disposed about a base axis and having a first surface and an opposing second surface. A plurality of comb elements are coupled to the base in a radial arrangement about the base axis. Each comb element includes a comb wall having a proximal portion positioned adjacent the base and an opposing distal portion extending away from the base and defining a serrated segment. A radially inward portion of the comb wall is positioned adjacent the base axis, and a radially outward portion extends away from the base axis.

The base may define a circular perimeter. The outer diameter of the base may be about 4 inches. The base may define a radius, and each comb element may extend along a radial axis between the base axis and an outer perimeter to define a radial comb length less than the radius. The plurality of comb elements may include a first set of comb elements and a second set of comb elements, wherein the radial comb length of each of the first set of comb elements is greater than the radial comb length of each of the second set of comb elements.

The plurality of comb elements may be retractable within the base. Each comb element may define an exposed portion extending from the base, and each comb element may be moveable relative to the base between an extended position and a retracted position. The length of the exposed portion may decrease as the comb element moves from the extended position to the retracted position. Each comb element may move axially relative to the base between the extended position and the retracted position.

The grooming tool may additionally include a cover configured to be selectively positional over the plurality of comb elements opposite the base.

The grooming tool may additionally be sold as part of a kit, which further includes a scraping element configured to be selectively engageable with the base. The scraping element may include a scraping end portion configured to scrape wax from the water sports board. The base may include a cutout extending therein from an external surface thereof. The cutout may be complimentary in shape to the scraping element, such that the scraping element may be selectively received within the cutout when the scraping element is engaged with the base.

The presently contemplated embodiments will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

Figure 1:
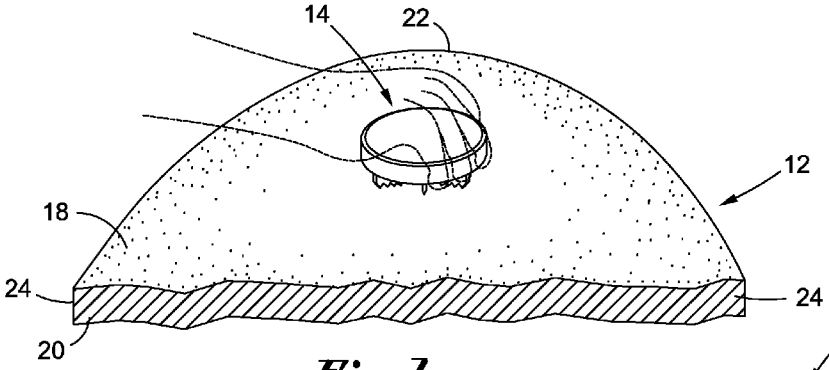
FIG. 1 is an upper perspective view of a wax comb constructed in accordance with an embodiment of the present invention shown in use for grooming wax on a surfboard.

The detailed description set forth below in connection with the appended drawings is intended as a description of the several presently contemplated embodiments of a surf wax grooming tool. The grooming tool includes a plurality of radially extending comb elements coupled to a common base to allow for more efficient grooming of wax. This description is not intended to represent the only form in which the disclosed invention may be developed or utilized. The description sets forth the functions and features in connection with the illustrated embodiments. It is to be understood, however, that the same or equivalent functions may be accomplished by different embodiments that are also intended to be encompassed within the scope of the present disclosure. It is further understood that the use of relational terms such as first and second and the like are used solely to distinguish one from another entity without necessarily requiring or implying any actual such relationship or order between such entities.

Referring now to the drawings, there is depicted a wax grooming tool 10 for a water sports board 12. The grooming tool 10 includes a wax comb 14 having a plurality of comb elements 16 coupled to a common base 15, wherein the comb elements 14 extend radially outward from a central portion of the base 15 toward a peripheral portion of the base 15. The plurality of comb elements 16 allow a user to save time when combing or grooming the wax on the water sports board 12 by reducing the amount of repetitions required to complete the combing or grooming. The unique configuration of the wax comb 14 further results in saved wax by thoroughly grooming the existing wax to a freshly-waxed state.

As used herein, the terms "surfboard" and "water sports board" 12 may be used interchangeably, and may also refer to stand up paddle boards, body boards, skim boards, or other equipment upon which wax is commonly applied and groomed with a conventional wax comb.

Referring now specifically to FIG. 1, conventional surfboards 12 include a deck (i.e., top surface) 18, an opposing bottom surface 20, a forward tip/nose 22, and a rearward tail (not shown). The deck 18 extends between a pair of opposed rails 24 on either side of the board 12. Typically, a surfer stands on the deck 18 while surfing, and thus, surf wax is usually applied on the deck 18 in the region which the surfer stands. In the case of longboard surfing, the surfer may walk along the deck from the nose 22 to the tail, and from one rail 24 to the opposing rail 24. In this regard, surf wax may be applied to the entire deck 18. FIG. 1 shows a user (in phantom) gripping the wax comb 14 in the palm of the user's hand and moving the wax comb 14 over the deck 18 to groom the wax residing thereon. As will be explained in more detail below, the wax comb 14 may be moved in an axial direction over the board 12, or alternatively, moved in a circular motion to create "swirls" within the wax.

Figure 2:
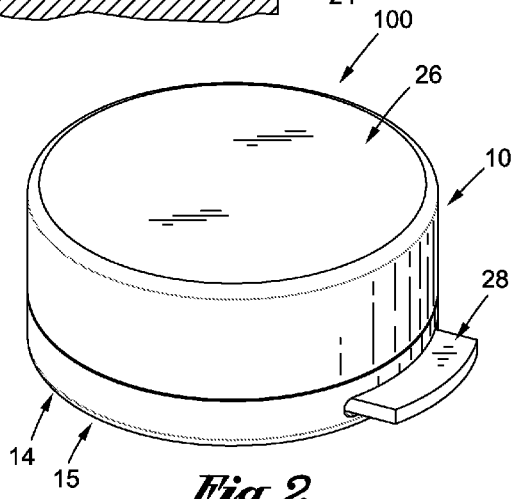
FIG. 2 is an upper perspective view of a grooming kit including the wax comb shown in FIG. 1, a cover placed over the wax comb, and a scraper stowed within the wax comb.
Figure 3:
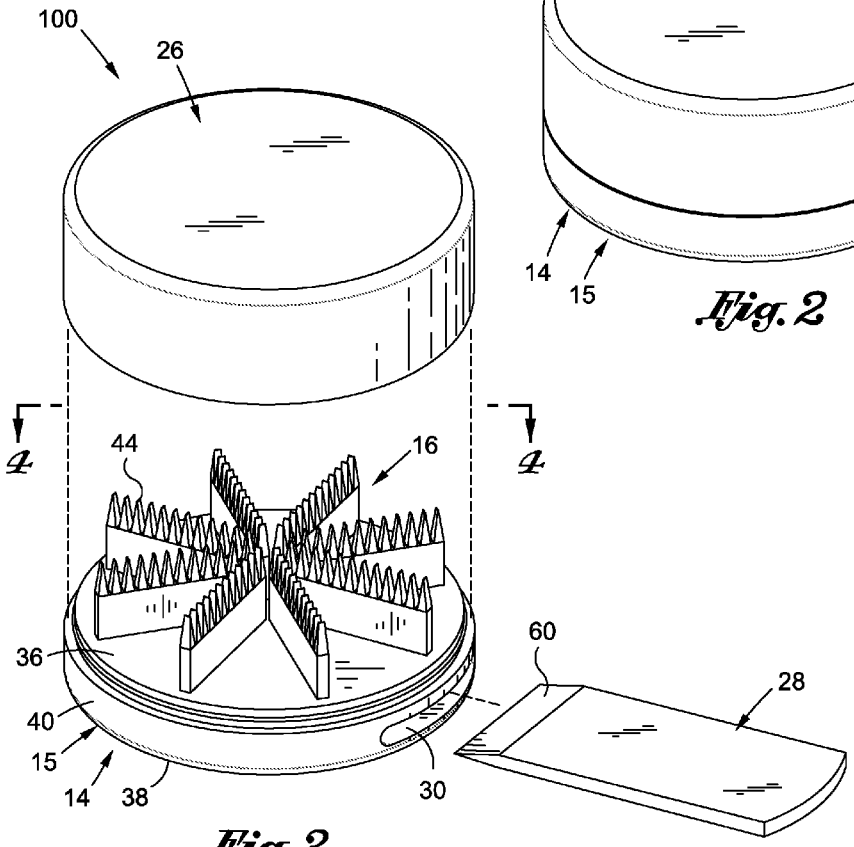
FIG. 3 is an exploded upper perspective view of the grooming kit depicted in FIG. 2.

FIG. 2 is an upper perspective view of the grooming tool 10, which includes the wax comb 14 and a cover 26 configured to be selectively postionable over the comb elements 16 to keep wax on the comb elements 16 from inadvertently falling from the tool 10. The grooming tool 10 may also be part of a kit 100, which includes the grooming tool 10 and a scraper 28, which will be described in more detail below. FIG. 3 is an exploded perspective view of the kit 100, showing the cover 26 removed from the wax comb 14, and the scraper 28 removed from a slot 30 formed in the wax comb 14.

The wax comb 14 includes a base 15 disposed about a central base axis 34 (see FIG. 7) and having a first surface 36 and an opposing second surface 38 both of which are generally orthogonal to the base axis 34. A peripheral sidewall 40 extends around the base axis 34 between the first surface 36 and the second surface 38.

The base 15 is configured to enable effortless gripping and manipulation of the wax comb 14. According to one embodiment, the base 15 defines a generally circular configuration that is hand-holdable in one hand by a human user. According to one embodiment, the base 15 defines an outer diameter "D" that is approximately equal to four inches, although those skilled in the art will readily appreciate that the outer diameter D of the base 15 may be larger than four inches or less than four inches without departing from the spirit and scope of the present invention. In a preferred embodiment, the base 15 is formed from a plastic material, although other materials known in the art may also be used. Furthermore, although the exemplary embodiment of the base 15 is circular, it is understood that the base 15 may define other shapes and configurations, such as oval, hexagonal, quadrangular, triangular or other shapes. In this respect, the present invention is not limited to a circular base 15.

The wax comb 14 includes a plurality of comb elements 16 coupled to the base 15 in a radial arrangement about the base axis 34. Each comb element 16 includes a comb wall having a proximal portion positioned adjacent the first surface 36 of the base 15 and an opposing distal portion extending away from the first surface 36 of the base 15. The distal portion of the comb element 16 defines a serrated configuration including a plurality of teeth 44, which are preferably integrally formed with the comb wall. The comb elements 16 are preferably formed of a plastic material, similar to the base, although other materials may also be used without departing from the spirit and scope of the present invention.

The comb elements 16 are arranged on the base 15 such that each comb element 16 extends in a radial direction from a central region (i.e., radially inward region) 46 (see FIGS. 4-6) of the base 15 toward a peripheral region (i.e., radially outward region) 48 (see FIGS. 4-6) of the base 15. In this respect, each comb element 16 includes a radially inward portion positioned adjacent the central base axis 34, and a radially outward portion extending away from the central base axis 34. As such, the plurality of comb elements 16 may be arranged on the base 15 to define an asterisk or star configuration.

Figure 4:
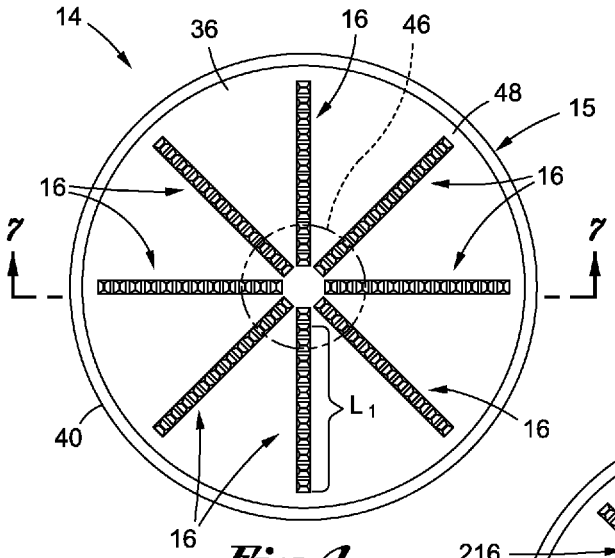
FIGS. 4-6 depict exemplary configurations of a plurality of comb elements arranged on a base of the wax comb.
Figure 5:
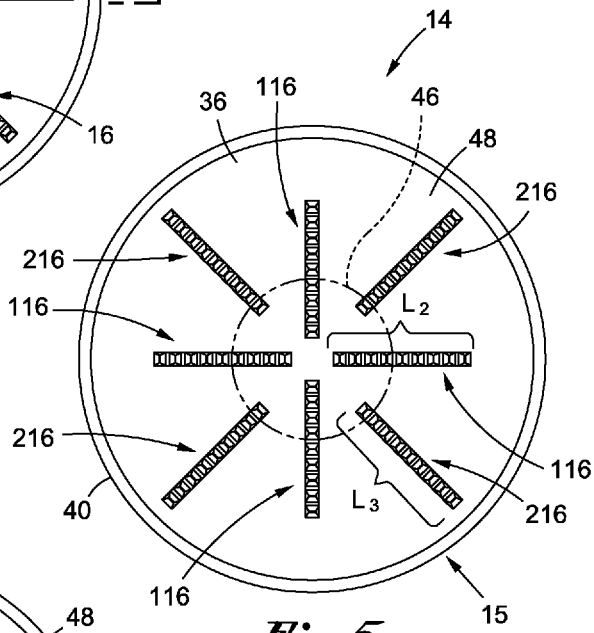
Figure 6:
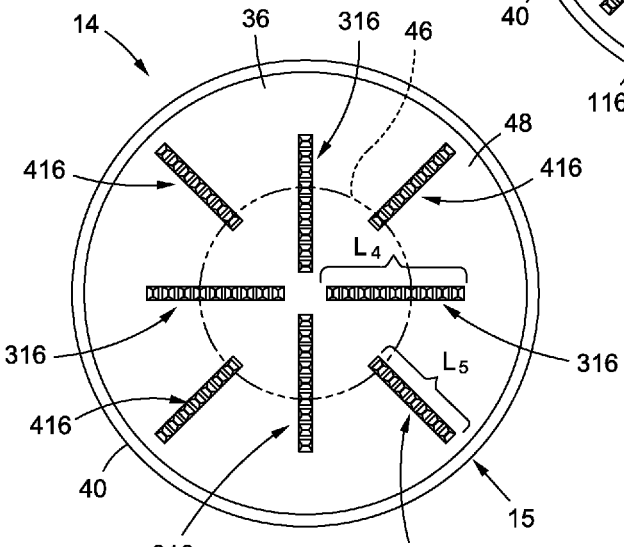

Referring now to FIGS. 4-6 there is depicted several different arrangements of the comb elements 16 on the base 15. Referring first to FIG. 4, each comb element 16 defines a radial length "$L_1$" along a radial axis that is generally perpendicular to the central base axis 34. The length $L_1$ of the comb elements 16 in the embodiment depicted in FIG. 4 are substantially equal to each other. Furthermore, the length $L_1$ is equal to approximately 90% of the radius of the peripheral wall 40.

Referring now specifically to FIG. 5, the wax comb 14 includes a first set of comb elements 116 and a second set of comb elements 216. The first set of comb elements 116 includes four comb elements 116 spaced in 90-degree increments. Each comb element 116 extends along a radial axis to define a length $L_2$. The second set of comb elements 216 also includes four comb elements 216 spaced in 90-degree increments. The second set of comb elements 216 are offset from the first set of comb elements 116 by approximately 45 degrees, which results in an alternating configuration (i.e., each first comb element 116 is positioned between a pair of second comb elements 216). Each comb element 216 extends along a radial axis to define a length $L_3$. According to one embodiment, the length $L_2$ is substantially equal to the length $L_3$.

The wax comb 14 depicted in FIG. 6 includes a comb configuration that is a slight derivation from the configuration depicted in FIG. 5, with the plurality of comb elements in FIG. 6 being of differing lengths. More specifically, the wax comb 14 of FIG. 6 includes a first set of comb elements 316 and a second set of comb elements 416. The first set of comb elements 316 includes four comb elements 316 spaced in 90-degree increments. Each comb element 316 extends along a radial axis to define a length $L_4$. The second set of comb elements 416 also includes four comb elements 416 spaced in 90-degree increments. The second set of comb elements 416 are offset from the first set of comb elements 316 by approximately 45 degrees, which results in an alternating configuration (i.e., each first comb element 316 is positioned between a pair of second comb elements 416). Each comb element 416 extends along a radial axis to define a length $L_5$. According to one embodiment, the length $L_4$ is larger than the length $L_5$.

The various comb configurations depicted in FIGS. 4-6 may be used to impart different textures or patterns within the wax. The configurations shown in FIGS. 4-6 are exemplary in nature only, and are not intended to limit the scope of the present invention. In this regard, the comb elements may be arranged in other configurations or patterns without departing from the spirit and scope of the present invention. Along these lines, although the exemplary wax comb 14 includes 8 comb elements, it is contemplated that other embodiments may include fewer than 8 comb elements, or alternatively, more than 8 comb elements. Furthermore, although the exemplary comb elements are configured to extend in an axial direction, it is also contemplated that the comb elements may be curvilinear or spiral-shaped.

Figure 7:
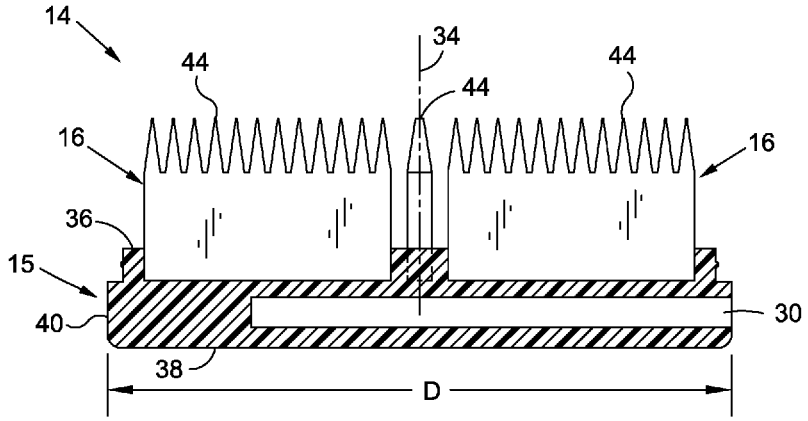
FIG. 7 is a cross sectional view of the wax comb depicted in FIG. 4.

Referring now to FIG. 7, there is shown a side sectional view of the wax comb 14 depicted in FIG. 4. In the embodiment depicted in FIG. 7, the comb elements 16 are rigidly securely coupled to the base 15. According to one embodiment, the comb elements 16 and base 15 are injection molded to form a single piece of plastic. However, in alternative embodiments where the comb elements 16 are formed separate from the base 15, an adhesive or similar bonding agent or mechanical coupler may be used to secure the comb elements 16 to the base 15.

Figure 8:
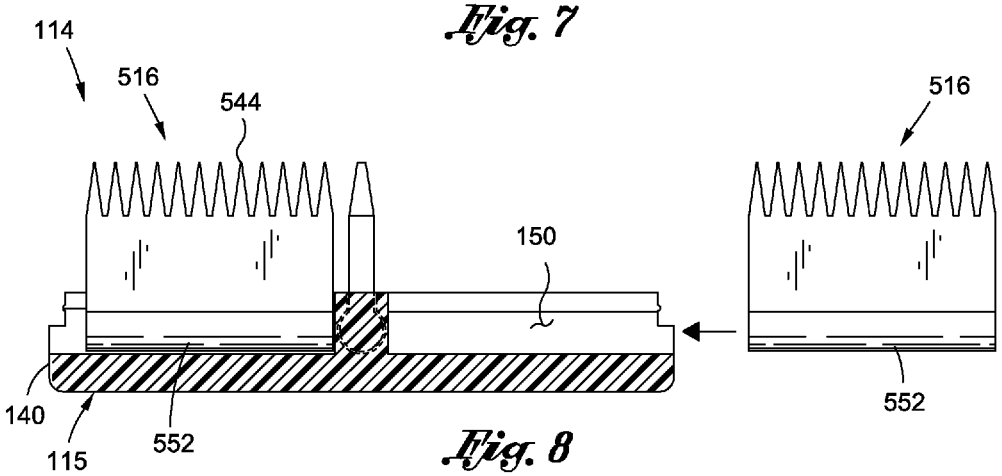
FIG. 8 is a cross sectional view illustrating the detachable engagement of the comb elements relative to the base.

Referring now to FIG. 8, there is shown a side sectional view of another embodiment of the wax comb 114, wherein the comb elements 516 are configured to be selectively detachable from the base 115. Detachment of one or more of the comb elements 516 from the base 115 may be desirable for cleaning the comb elements 516 (e.g., removing wax from the teeth 544 of the comb elements 516), as well as to replace the comb elements 16 in the event one of the comb elements 16 breaks.

In order to effectuate detachment of the comb elements 516 from the base 115, the comb elements 516 and base 15 include complimentary engagement portions. In the embodiment depicted in FIG. 8, the base 115 includes a plurality of grooves 150 extending into the base 115 from the peripheral sidewall 140, and the comb elements 516 include a tail 552 that corresponds to the groove 150, and allows the comb element 516 to slide or translate within the groove 150. The groove 150 and tail 552 may be configured to lock the comb element 516 in the base 115 when the comb element 516 is completely inserted therein. It is also contemplated that in other embodiments, the groove may be formed in the comb elements 516 and the corresponding tail may be formed on the base 115.

Figure 9:
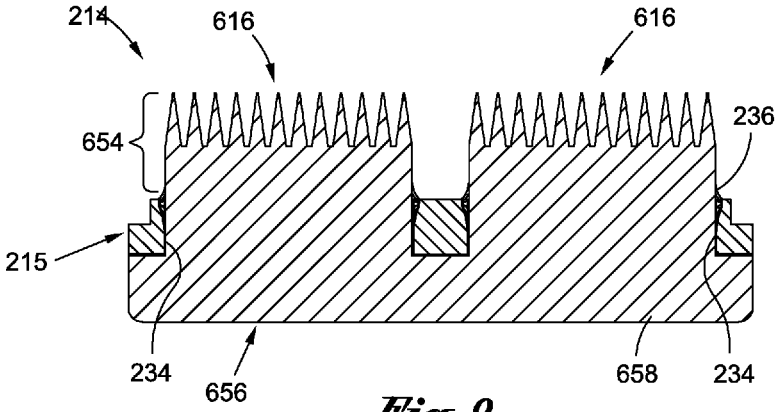
FIG. 9 is a cross sectional view of another embodiment of the wax comb including a retractable comb assembly moveable relative to the base.

Referring now to FIG. 9, there is shown yet another embodiment of the wax comb 214, wherein the plurality of comb elements 616 are at least partially retractable through the base 215. To that end, the wax comb 214 depicted in FIG. 9 includes a comb assembly 656 comprised of the comb elements 616, which are interconnected via an end plate 658. More specifically, each comb element 616 is attached to the end plate 658 opposite the serrated/toothed end of the comb element 616. The base 215 includes openings 234 extending axially therethrough, wherein the openings 234 are sized and positioned to allow respective ones of the comb elements 616 to extend therethrough.

The comb assembly 656 is selectively transitional relative to the base 215 between extended and retracted positions. The comb assembly depicted in FIG. 9 is shown in the extended position, with the comb elements 616 extending through the openings 234 of the base 215. As the comb assembly 656 transitions from the extended position to the retracted position, the comb elements 616 are withdrawn from the openings 234 and the end plate 658 is moved away from the base 215. Along these lines, each comb element 616 may define an exposed portion 654 extending from the base 215, wherein the length of the exposed portion 654 decreases as the comb assembly 656 moves from the extended position toward the retracted position.

The base 215 may include a brush or bristles 236 extending into the openings 234 such that as the comb elements 616 are retracted and advanced through the openings 234, the bristles 236 clean the comb elements 616 by removing wax or other debris therefrom.

Referring back to FIGS. 2 and 3, the grooming tool 10 may additionally include a cover 26 configured to be selectively positional over the plurality of comb elements 16. The cover 26 may be configured to be cooperatively engageable with the base 15 such that the cover is secured to the base 15 when engaged therewith. The cover 26 may be fabricated from a plastic material, or other materials known by those skilled in the art.

As noted above, the base 15 may further be configured to engage with a scraping element or scraper 28, which may be used in conjunction with the wax comb 14. In this respect, the scraper 28 includes a scraping end portion 60 configured to scrape wax from the surfboard 12. According to one embodiment, the base 15 includes a cutout 30 or slot extending therein from an exterior surface thereof. As shown in FIGS. 2, 3, 7, the slot 30 extends into the base 15 from the peripheral surface thereof, although it is also contemplated that a cutout may extend from the second surface of the base 15.

This disclosure provides exemplary embodiments of the present invention. The scope of the present invention is not limited by these exemplary embodiments. Numerous variations, whether explicitly provided for by the specification or implied by the specification, such as variations in structure, dimension, type of material and manufacturing process may be implemented by one of skill in the art in view of this disclosure.

What is claimed is:

1. A grooming tool for a water sports board comprising:

a base disposed about a base axis and having a first surface and an opposing second surface, and a plurality of grooves extending into the base from a peripheral sidewall; and a plurality of comb elements coupled to the base and extending radially outward from the base axis, each comb element including:

an extension wall extending away from the base in a first direction and extending longitudinally in a second direction orthogonal to the first direction and radially outward from the base axis; and a plurality of teeth arranged in a linear array and coupled to the extension wall, with the extension wall extending between the plurality of teeth and the base;

the plurality of comb elements being selectively detachable from the base.

2. The grooming tool recited in claim 1, wherein the base defines a circular perimeter.

3. The grooming tool recited in claim 2, wherein the circular perimeter is about 4 inches in diameter.

4. The grooming tool recited in claim 1, wherein the base is of a circular configuration and defines a radius, each comb element extending along a radial axis between the base axis and an outer perimeter to define a radial comb length less than the radius.

5. The grooming tool recited in claim 4, wherein the plurality of comb elements includes a first set of comb elements and a second set of comb elements, wherein the radial comb length of each of the first set of comb elements is greater than the radial comb length of each of the second set of comb elements.

6. The grooming tool recited in claim 1, further comprising a cover configured to be selectively positional over the plurality of comb elements opposite the base.

7. The grooming tool recited in claim 1, wherein each comb element includes a tail being complimentary to a respective one of the plurality of grooves.

8. The grooming tool recited in claim 7, wherein the plurality of comb elements are adapted to translate radially relative to the base within respective ones of the grooves, each comb element being translatable away from the base axis to detach the comb element from the base.

9. The grooming tool recited in claim 8, wherein the plurality of grooves and the plurality of tails are configured to lock the plurality of comb elements in the base.

10. The grooming tool recited in claim 8, wherein each comb element is formed from a plastic material.

11. A wax grooming tool for a water sports board, the wax grooming tool comprising:

a base having a central region, a surrounding peripheral region defining a peripheral sidewall, and a plurality of grooves extending into the base from the peripheral sidewall; and a plurality of comb elements coupled to the base, each comb element extending from the central region in a radially outward direction toward the peripheral region, the plurality of comb elements extending radially outward from a common central axis;

the plurality of comb elements being selectively detachable from the base.

12. The wax grooming tool recited in claim 11, wherein the plurality of comb element are configured to slide within the base in a radial direction.

* * * * *